United States Patent [19]

Ayers

[11] 4,342,892

[45] Aug. 3, 1982

[54] KEYSWITCH

[75] Inventor: Robert D. Ayers, Raleigh, N.C.

[73] Assignee: Stackpole Components Company, Raleigh, N.C.

[21] Appl. No.: 176,499

[22] Filed: Aug. 8, 1980

[51] Int. Cl.[3] ..... H01H 1/26; H01H 13/52

[52] U.S. Cl. ..... 200/159 A; 200/246; 200/283

[58] Field of Search ..... 200/159 A, 275, 283, 200/340, 246

[56] References Cited

U.S. PATENT DOCUMENTS

| | | | |
|---|---|---|---|
| 259,825 | 6/1882 | Davis | 200/159 A |
| 2,332,554 | 10/1943 | Bolley | 200/340 |
| 3,751,618 | 8/1973 | Hallenberg | 200/283 |
| 3,902,032 | 8/1975 | Koepke | 200/159 A |

*Primary Examiner*—John W. Shepperd

*Attorney, Agent, or Firm*—Brown, Flick & Peckham

[57] ABSTRACT

A keyswitch includes a tubular plunger with a body slidable vertically in an open-top housing that has a bottom wall supporting the lower end of a coil spring extending up around a pair of opposed upright spring contact strips, the lower ends of which extend through the bottom wall. The inside of the plunger is provided with a cross member that normally separates the upper ends of the contact strips, but permits them to engage each other when the plunger is pushed down. The contact strips are substantially identical. Each has at least two parallel slits extending downwardly from its upper end to form a plurality of narrow contact fingers beside a wider contact finger that is wide enough to be engaged by the narrow contact fingers of the opposing contact strip.

2 Claims, 5 Drawing Figures

Fig. 5
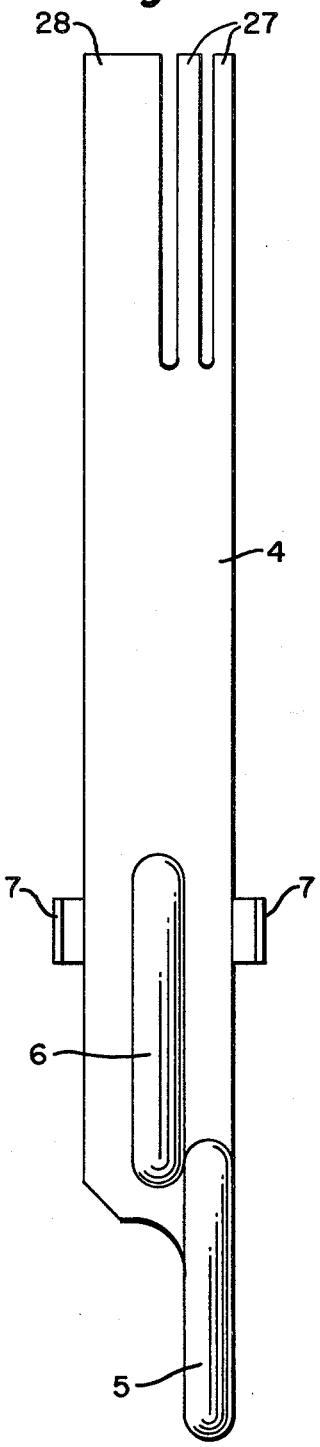
Fig. 1
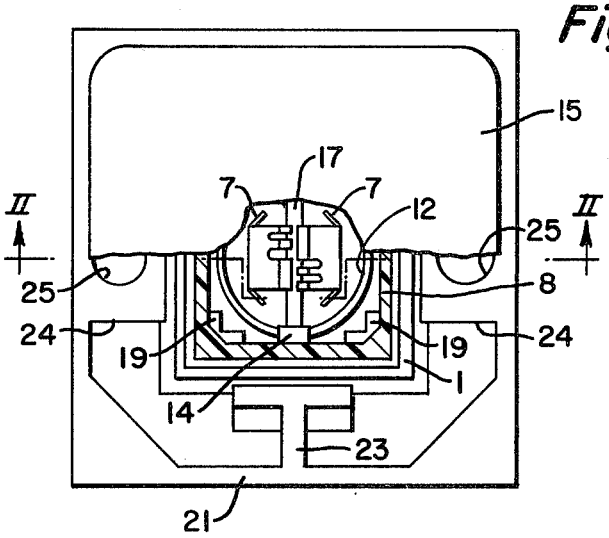
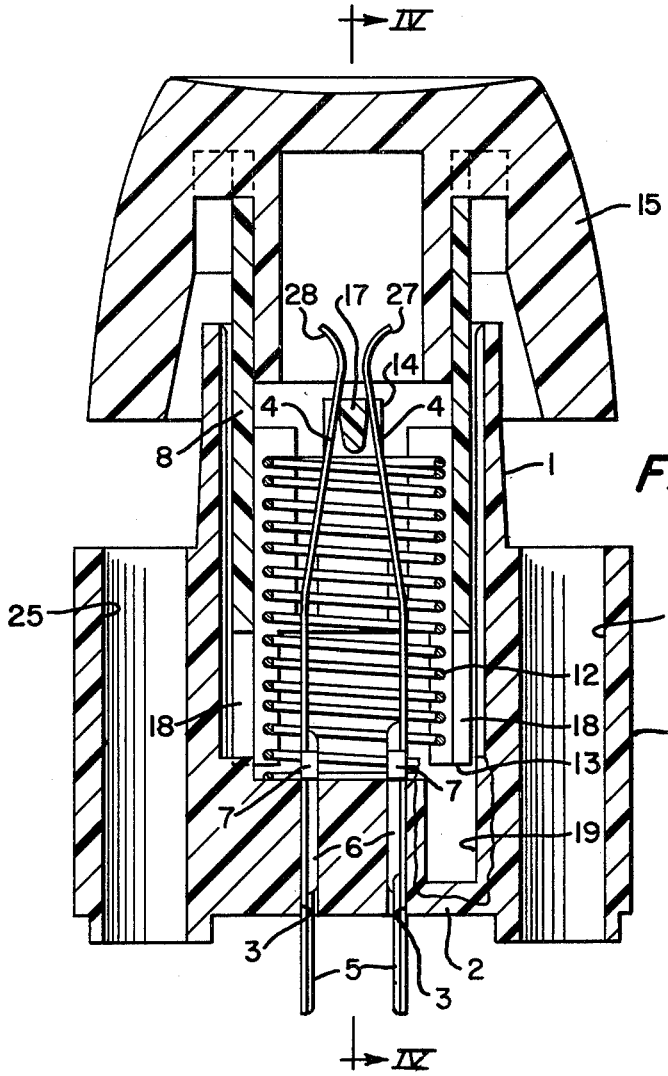
Fig. 2

KEYSWITCH

The keyswitch disclosed in this application is of the type shown in the copending patent application, Ser. No. 075,945, filed Sept. 17, 1979, now U.S. Pat. No. 4,255,635 in which two upstanding spring contacts normally are held apart inside a plunger but are permitted to close when the plunger is depressed against the resistance of a return spring.

It is among the objects of this invention to provide a keyswitch of the type just mentioned, in which satisfactory engagement of the two spring contacts with each other is assured, and in which the spring contacts are identical.

The preferred embodiment of the invention is illustrated in the accompanying drawings, in which FIG. 1 is a plan view, with part of the keycap broken away;

FIG. 2 is an enlarged vertical section taken on the line II—II of FIG. 1 and showing the switch open;

FIG. 5 is an enlarged view of one of the spring contact strips.

Figure 4:
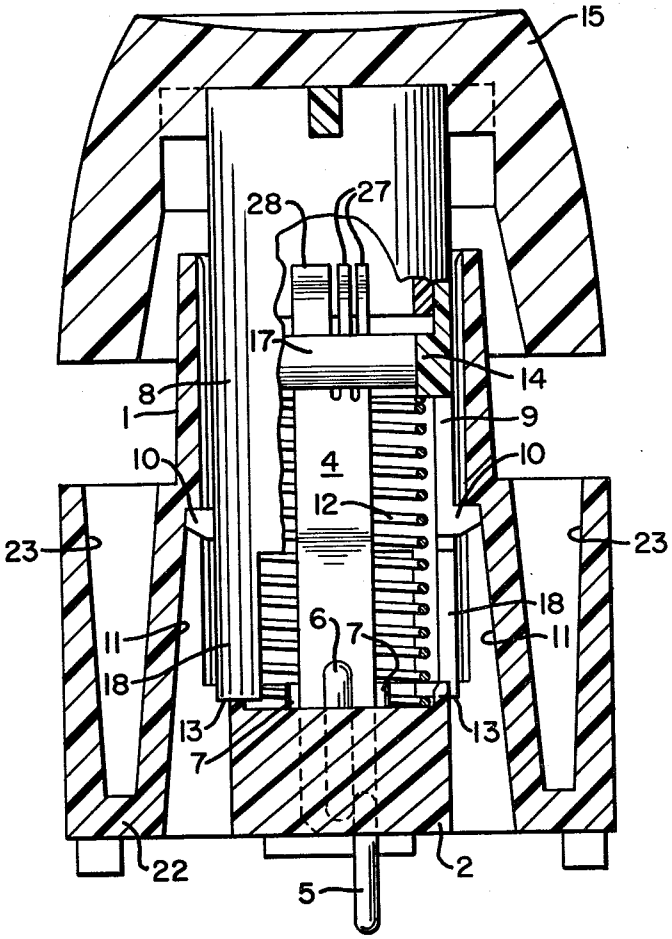
FIG. 4 shows the open keyswitch turned 90° from its position in FIG. 2, with the housing and keycap in vertical section and part of the plunger broken away.

Referring to FIGS. 1 and 2 of the drawings, a rectangular switch housing 1 has an open upper end and a lower end closed by a relatively thick bottom wall 2. The bottom wall is provided with a pair of laterally spaced slots 3 extending substantially vertically therethrough. Fitting tightly in these slots is a pair of spring contact strips 4 that project below the wall to form electric terminals 5 that may be plugged into a printed circuit board. The portion of each contact strip in a slot 3 is provided with a pressed-out vertical rib 6 so that the strip has to be forced down through the slot to form a press fit. The distance the strip can be inserted in the slot is limited by tangs 7 projecting from opposite edges of the strip into engagement with an upper surface of bottom wall 2. This manner of holding the contact strips in place has the advantage that a defective strip can easily be pulled up out of the switch housing without removing the housing from the printed circuit board on which the housing is mounted, and a new contact strip then inserted in place of the defective one.

Figure 3:
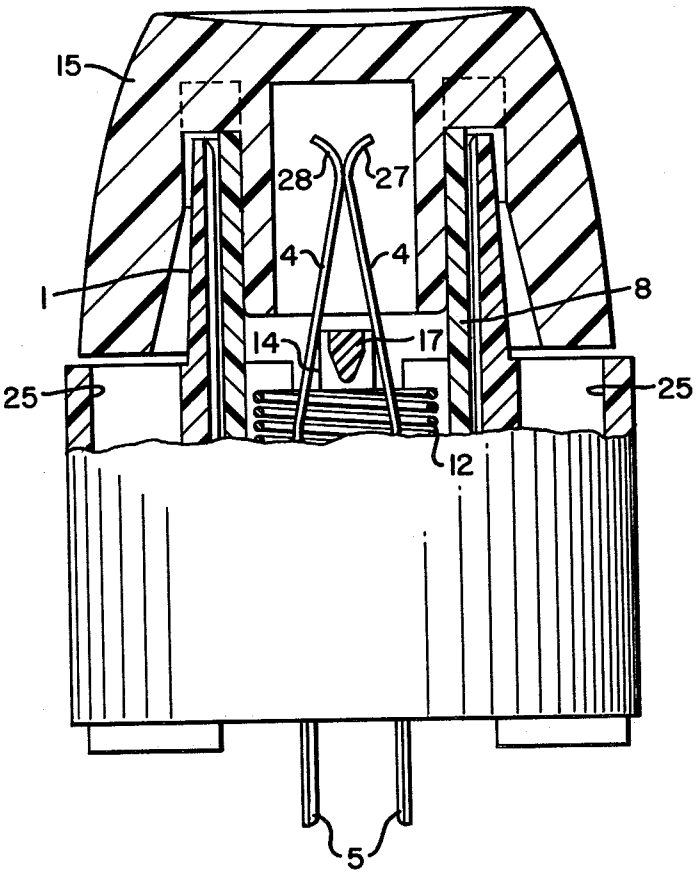
FIG. 3 is a fragmentary view similar to FIG. 2, but showing the kepcap depressed to permit the switch to close.

The contact strips 4 extend upwardly in the housing and, as shown in FIG. 3, their upper portions are inclined toward each other sufficiently to come into engagement with each other near their upper ends. Above their engaging or contact points the two strips are curved away from each other.

Disposed in the switch housing is a tubular plunger that has a rectangular body 8 slidably engaging the housing for movement up and down in it. As shown in FIG. 4, two opposite sides of the plunger body are provided with upwardly extending slits to form tongues 9 that have outwardly projecting lugs 10 at their lower ends. The lower portions of the housing side walls beside these tongues are provided with vertical slots 11, into which the lugs snap when the plunger is inserted in the housing. The purpose of the lugs is to limit upward travel of the plunger in the housing in order to lock it in the housing. The plunger normally is held in its upper position, determined by engagement of the lugs with the upper ends of slots 11, by a coil spring 12 seated in a recess 13 in the top of the bottom wall. The spring encircles the contact strips but is spaced from them. The fit of the lower end of the spring in the recess prevents any lateral shifting of the spring that might cause it to engage the contacts. The upper end of the spring engages projections 14 on opposite sides of the plunger. While the plunger is held in its upper position by the spring, the lower end of the plunger body is spaced from the bottom wall of the housing as shown in FIG. 2. Mounted on the upper end of the plunger is a keycap 15 for depressing the plunger against the resistance of the coil spring.

While the plunger is in its upper position shown in FIG. 2, the two contact strips are held apart by a cross member 17 in the plunger that is integrally connected with the two projections 14. The lower portion of this cross member is tapered downwardly so that as the plunger is being assembled with the housing the cross member will easily slide down between the upper ends of the contact strips as it spreads them apart. In the upper position of the plunger this cross member holds the contact strips out of engagement with each other. When the keycap is depressed, as shown in FIG. 3, the cross member is moved down out of engagement with the contacts to permit them to move together to complete a circuit through the switch.

In spite of the relatively thick bottom wall of the housing and the resulting relatively short body of the plunger, there is enough length of the plunger engaging the housing when the plunger is in its upper position to prevent wobble of the plunger and keycap. Accordingly, as shown in FIGS. 2 and 4, the plunger body has legs 18 extending downwardly from its four corners for engaging that area of the housing between the plunger body and the bottom wall of the housing while the plunger is elevated. In other words, the plunger engages the housing for substantially the full length of the inside of the housing while the plunger is raised. To permit the plunger to be depressed, the corners of the bottom wall are provided with downwardly extending sockets 19 for receiving the plunger legs 18. Preferably, each leg has two sides at right angles to each other for engaging two adjoining sides of the housing, and each socket has flat sides forming continuations of the housing sides above it.

To facilitate mounting the switch in place, it is preferred to surround the lower portion of the housing by an outer wall 21 that is square and has a thin bottom wall 22 (FIG. 4) connected with the thick bottom wall of the housing. Suitable vertical ribs 23 and 24 connect this outer wall with the side walls of the housing. Ribs 24 are provided with vertical passages 25 for receiving screws to hold the housing on a printed circuit board. A snap-in type of mounting can be used if the keyswitch is to be mounted on a panel.

Except for the spring and the contact strips, all of this keyswitch preferably is formed from molded plastic.

It is a feature of this invention that the two spring contact strips 4 in a switch are so made that they are identical, so that only one form of spring contact needs to be made, and it is formed for good performance over the life of the switch. In some cases in the past the upper end of only one of the spring contact strips was provided with downwardly extending slits forming laterally spaced contact fingers, while the other spring contact was unslitted or solid. It has been found that such a combination of spring contacts is not very dependable in operation, in addition to which it requires the production of two different forms of contacts. It also has been proposed that both contact strips be provided with laterally spaced contact fingers, all of which have the same width. Although in such a case both spring contacts could be formed alike, they often did not perform well in practice. To overcome these difficulties both spring contacts disclosed herein are identical, with the upper end portion of each strip provided with parallel downwardly extending slits separating the strip into two or more narrow contact fingers 27 beside a wide contact finger 28. The wide contact finger on each contact strip is wide enough to be engaged by all of the narrow contact fingers on the opposing contact strip, as shown in FIG. 1. This arrangement has been found to give good electrical contact between the contact strips throughout the life of the switch. Also, with the contact strips being alike, there is no chance of using the wrong combination of contact strips in assembling a switch. Since both contact strips are as alike as any two parts can be, the line of contact between them is nearly perfectly centered within the plunger, which is important during plunger assembly and which enhances the operating geometry. Moreover, there is no need for two separate dies or for changing die stations to make the two contacts. Both can be made in the same die.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A keyswitch comprising a housing having a bottom wall and an open upper end, a plunger having a tubular body extending downwardly in the housing and slidably engaging said housing for movement up and down therein, means limiting upward travel of the plunger to a predetermined elevated position, the lower end of said body being spaced above said bottom wall while the plunger is in said elevated position, said bottom wall being provided with a pair of laterally spaced openings extending substantially vertically therethrough, a pair of opposed spring contact strips mounted in said openings and projecting below said wall to form terminals, said contact strips also converging upwardly inside the plunger and having normally engaging upper ends, a cross member inside the plunger body and supported thereby between the contact strips, and a coil spring inside the plunger below said cross member and encircling the contact strips but spaced therefrom, said spring normally holding the plunger in said elevated position with said cross member spreading the upper ends of the contacts apart, said downward movement of the plunger in said housing disengaging said cross member from the contacts, and said contact strips being substantially identical and each having at least two parallel slits extending downwardly from its upper end to form a plurality of laterally spaced narrow contact fingers at one side of a wider contact finger wide enough to be engaged by the narrow contact fingers of the other contact strip when said cross member is disengaged from the contact strips.

2. A keyswitch according to claim 1, in which each of said contact strips is provided with only two of said slits and they are located at one side of the longitudinal center line of the strip to form two narrow contact fingers for engaging said wider contact finger of the other contact strip.

* * * * *